US007237472B2

(12) United States Patent
Cove

(10) Patent No.: US 7,237,472 B2
(45) Date of Patent: Jul. 3, 2007

(54) LINEAR HYDRAULIC STEPPING ACTUATOR WITH FAST CLOSE CAPABILITIES

(75) Inventor: Harry Richard Cove, Edmonton (CA)

(73) Assignee: Master Flo Valve, Inc., Edmonton (CA)

( * ) Notice: Subject to any disclaimer, the term of this patent is extended or adjusted under 35 U.S.C. 154(b) by 240 days.

(21) Appl. No.: 11/032,679

(22) Filed: Jan. 10, 2005
(Under 37 CFR 1.47)

(65) Prior Publication Data

US 2006/0192160 A1 Aug. 31, 2006

Related U.S. Application Data

(60) Provisional application No. 60/535,555, filed on Jan. 9, 2004.

(51) Int. Cl.
*F15B 11/08* (2006.01)

(52) U.S. Cl. ..... 91/437; 60/473

(58) Field of Classification Search ..... 137/625.33; 91/35, 37, 38, 437; 60/473, 494
See application file for complete search history.

(56) References Cited

U.S. PATENT DOCUMENTS

| | | | | |
|---|---|---|---|---|
| 4,147,325 | A * | 4/1979 | McGee | 251/25 |
| 4,540,022 | A | 9/1985 | Cove | |
| 4,723,474 | A | 2/1988 | Flohr | |
| 4,774,980 | A | 10/1988 | Etheridge | |
| 5,074,519 | A | 12/1991 | Pettus | |
| 5,211,241 | A | 5/1993 | Mashaw, Jr. et al. | |
| 5,316,084 | A | 5/1994 | Murray et al. | |
| 5,431,188 | A | 7/1995 | Cove | |
| 6,179,052 | B1 | 1/2001 | Purkis et al. | |
| 6,327,956 | B1 * | 12/2001 | Rink | 91/28 |
| 6,422,317 | B1 | 7/2002 | Williamson, Jr. | |
| 6,450,255 | B2 | 9/2002 | Carmody et al. | |
| 6,470,970 | B1 | 10/2002 | Purkis et al. | |
| 6,484,800 | B2 | 11/2002 | Carmody et al. | |
| 6,543,544 | B2 | 4/2003 | Schultz et al. | |
| 6,575,237 | B2 | 6/2003 | Purkis et al. | |

(Continued)

FOREIGN PATENT DOCUMENTS

| | | |
|---|---|---|
| CA | 2398715 | 8/2001 |
| GB | 2401888 A | 11/2004 |
| WO | WO 99/47788 A1 | 9/1999 |
| WO | WO 01/90532 A1 | 11/2001 |
| WO | WO 02/20941 A1 | 3/2002 |
| WO | WO 2004/033849 A1 | 4/2004 |

*Primary Examiner*—John Fox
(74) *Attorney, Agent, or Firm*—Greenlee Winner and Sullivan, P.C.

(57) ABSTRACT

The invention provides a choke system with hydraulic circuits which provide choke valve positioning that can be varied by the use of incremental steps. The incremental movement action in either the opening or closing direction is accomplished through the use of one of the two hydraulic slave cylinders which can either add or subtract a fixed volume of hydraulic fluid from the choke actuator. A series of check valves provides direction for flow in the hydraulic lines, locking of the choke actuator, and re-filling of the slave cylinders during operation. The system eliminates excessive lines or solenoid valves and avoids the need for mechanical locking mechanisms. Preferred embodiments include a "fast close" system which, instead of running through a series of steps to close the valve, provides valve control in a fast close line to move the choke actuator to the full closed position from anywhere in the travel over a shorter period of time than through normal stepping operation.

17 Claims, 6 Drawing Sheets

U.S. PATENT DOCUMENTS 6,585,051 B2 7/2003 Purkis et al.
6,585,227 B2 7/2003 Newport et al.
6,612,547 B2 9/2003 Carmody et al.
6,668,936 B2 12/2003 Williamson, Jr. et al.
6,691,587 B1 2/2004 King
6,722,439 B2 4/2004 Garay et al.
6,736,213 B2 5/2004 Bussear et al.
6,782,949 B2 8/2004 Cove et al.
6,782,952 B2 8/2004 Garay et al.
7,003,949 B2 * 2/2006 Fenny et al. ..... 60/468
2003/0048197 A1 3/2003 Purkis et al.
2004/0069491 A1 4/2004 Garay et al.
2004/0216884 A1 11/2004 Bodine et al.
2004/0216888 A1 11/2004 Schmidt et al.

* cited by examiner

LINEAR HYDRAULIC STEPPING ACTUATOR WITH FAST CLOSE CAPABILITIES

CROSS-REFERENCE TO RELATED APPLICATION

This application claims the benefit under 35 USC §119 of U.S. patent application No. 60/535,555, filed Jan. 9, 2004, the disclosure of which is incorporated herein by reference in its entirety to the extent not inconsistent herewith.

FIELD OF THE INVENTION

The invention relates to a choke system with a hydraulic actuator, such as is used in an oil or gas wellhead.

BACKGROUND OF THE INVENTION

A choke valve is a throttling device. It is commonly used as part of an oil or gas field wellhead. It functions to reduce the pressure of the fluid flowing through the valve internals. Choke valves are placed on the production "tree" of an oil or gas wellhead assembly to control the flow of produced fluid from a reservoir into the production flow line. They are used on wellheads located on land and offshore, as well as on wellheads located beneath the surface of the ocean.

In general, chokes involve:

- a valve body having an axial bore, a body inlet (typically referred to as a side outlet) and a body outlet (typically referred to as an end outlet);
- a "flow trim" mounted in the bore between inlet and outlet, for throttling the flow moving through the body; and
- means for actuating the flow trim, said means closing the end of the bore remote from the outlet.

There are four main types of flow trim commonly used in commercial chokes. Each flow trim involves a port-defining member, a movable member for throttling the port, and seal means for implementing a total shut-off. These four types of flow trim can be characterized as follows:

(1) a needle-and-seat flow trim comprising a tapered annular seat fixed in the valve body and a movable tapered internal plug for throttling and sealing in conjunction with the seat surface;

(2) a cage-with-internal-plug flow trim, comprising a tubular, cylindrical cage, fixed in the valve body and having ports in its side wall, and a plug movable axially through the bore of the cage to open or close the ports. Shut-off is generally accomplished with a taper on the leading edge of the plug, which seats on a taper carried by the cage or body downstream of the ports;

(3) a multiple-port-disc flow trim, having a fixed ported disc mounted in the valve body and a rotatable ported disc, contiguous therewith, that can be turned to cause the two sets of ports to move into or out of register, for throttling and shut-off; and (4) a cage-with-external-sleeve flow trim, comprising a tubular cylindrical cage having ports in its side wall and a hollow cylindrical sleeve that slides axially over the cage to open and close the ports. The shut-off is accomplished with the leading edge of the sleeve contacting an annular seat carried by the valve body or cage.

In each of the above, the flow trim is positioned within the choke valve at the intersection of the choke valve's inlet and outlet. In most of the valves, the flow trim includes a stationary tubular cylinder referred to as a "cage", positioned transverse to the inlet and having its bore axially aligned with the outlet. The cage has restrictive flow ports extending through its sidewall. Fluid enters the cage from the choke valve inlet, passes through the ports and changes direction to leave the cage bore through the valve outlet.

Such a flow trim also includes a tubular throttling sleeve that slides over the cage. The sleeve acts to reduce or increase the area of the ports. An actuator, such as a threaded stem assembly, is provided to bias the sleeve back and forth along the cage. The rate that fluid passes through the flow trim is dependent on the relative position of the sleeve on the cage and the amount of port area that is revealed by the sleeve.

Maintenance on the deep subsea wellhead assemblies cannot be performed manually. An unmanned, remotely operated vehicle, referred to as an "ROV", is used to approach the wellhead and carry out maintenance functions. To aid in servicing subsea choke valves, choke valves have their internal components, including the flow trim, assembled into a modular sub-assembly. The sub-assembly is referred to as an "insert assembly" and is inserted into the choke valve body and clamped into position.

When the flow trim becomes worn beyond its useful service life due to erosion and corrosion caused by particles and corrosive agents in the produced substances, an ROV is used to approach the choke valve, unclamp the insert assembly from the choke valve body and attach a cable to the insert assembly so that it may be raised to the surface for replacement or repair. The ROV then installs a new insert assembly and clamps it into position. This procedure eliminates the need to raise the whole wellhead assembly to the surface to service a worn choke valve.

In order to efficiently produce a reservoir, it is necessary to monitor the flow rate of the production fluid. This is done to ensure that damage to the formation does not occur and to ensure that well production is maximized. This process has been, historically, accomplished through the installation of pressure and temperature transmitters into the flow lines upstream and downstream of the choke valve. The sensor information is then sent to a remote location for monitoring, so that a choke valve controller can remotely bias the flow trim to affect the desired flow rate. The controller sends electrical signals to means, associated with the choke valve, for adjusting the flow trim.

Choke valves common to oil and gas field use are generally described in U.S. Pat. No. 4,540,022, issued Sep. 10, 1985, to Cove and U.S. Pat. No. 5,431,188, issued Jul. 11, 1995 to Cove. A subsea choke valve is described in U.S. Pat. No. 6,782,949, issued Aug. 31, 2004. All of these patents are assigned to Master Flo Valve Inc., the owner of this application.

Control valves, such as choke valves, are often equipped with a means to provide position control. In the most fundamental form, manual operation by a lever or hand wheel is used. To provide remote control of a valve's position a variety of actuators, including hydraulic actuators, can be used.

U.S. Patent Application published Nov. 4, 2004 as US 2004/02116884 and naming Bodine et al. as inventors, describes known hydraulic actuator control systems for subsea chokes as follows:

In offshore oil and gas production, it is often common for more than one well to be produced through a single flow line. In a typical installation, the products from each individual well flow are combined into a common flow line, which then carries the products to the surface or combines those products with the products of other flow lines. The difficulty in managing a multiple well completion produced through a single flow line is that not all of the wells may be producing at the same pressure conditions or include the same flow constituents (liquids and gases).

For example, if one individual well is producing at a lower pressure than the pressure maintained in the flow line, fluid can back flow from the flow line into that well. Not only is the loss of production fluids undesirable, but the pressure changes and reverse flow conditions within that well may damage the well and/or reservoir. Similarly, if one well is producing at a pressure above the flow line pressure, that well may produce at an undesirable flow rate and pressure, again with the potential to damage other wells and/or the reservoir. Thus, the management of flow rates and pressures is of critical importance in maximizing the production of hydrocarbons from the reservoir.

In one prior art subsea production system, control signals and a hydraulic fluid supply are transmitted along an umbilical from a topside control system to a subsea control module which supplies hydraulic fluid to actuators in the subsea trees, manifolds, valves, choke and other functions. As control valves within the control module receive signals to open or close the choke, the control valves actuate to control the flow of hydraulic fluid to the choke actuator through either hydraulic lines opening or closing. A common choke actuator is a hydraulic stepping actuator, which, depending on the style of actuator and choke being used, may take 100 to 200 steps to close, although systems requiring a smaller, or larger, number of steps are possible. Each step involves the actuator receiving a pulse of hydraulic pressure, which moves the actuator, and then a release of that pressure, which allows a spring to return the actuator to its initial position. In typical systems, where the SCM (subsea control module) is located proximate (e.g., within about 30-feet) to the choke/actuator, about one second is required for the pressure pulse to travel from the control valve in SCM to the actuator and two seconds are required for the spring to return the actuator to its initial position. Thus, with a total of three seconds per step and a total of up to 200 or more steps required to fully actuate the choke, the time required to fully close or open the choke is considerable. The risk of equipment failure is also increased due to the components being actuated hundreds, thousands, or even millions, of times.

In another typical prior art subsea production system, control signals and a hydraulic fluid supply are transmitted along an umbilical from a topside control system directly to a subsea choke, bypassing the subsea control module on an electro hydraulic control system. Operation of a direct hydraulic control system would also be as described above, since no subsea control module is required, and a direct electric (control) system would operate similarly, minus any hydraulic control lines. The choke is opened and also closed via hydraulic signals transmitted through dedicated umbilical lines. Hydraulic signals from the surface control the flow of hydraulic fluid to the choke actuator through either hydraulic opening and closing lines. The common choke actuator is a hydraulic stepping actuator which, depending on the style of actuator and choke being used, may take 100–200 steps to close. Each step involves the actuator receiving a pulse of hydraulic pressure, which moves the actuator, and then a release of that pressure, which allows a spring to return the actuator to its initial position. In typical systems, the time required for the pressure pulse to travel from the surface to the actuator is directly related to the offset distance (umbilical length from surface to choke), water depth and actuating pressure, which can be minutes per step for long offsets. Also, an additional amount of time is required for the spring to return the actuator to its initial position. The time to actuate each step can run into minutes, thus, with a total of up to 200 steps required to fully actuate the choke, the time required to fully close or open the choke is considerable.

In yet a third typical prior art subsea production system, electrical power and a hydraulic fluid supply are transmitted along an umbilical from a topside control system directly to a subsea choke actuator system, bypassing the subsea control module on an electro hydraulic control system. Operation of a direct hydraulic control system would also be as described above, since no subsea control module is required, and a direct electric (control) system would operate similarly, minus any hydraulic control lines. A hydraulic fluid supply is stored local to the choke, such as in accumulator. The choke is opened and also closed via electrical signals transmitted through dedicated umbilical conductors to actuate the open and close functions. The electrical signals are received by a directional control valve that regulates hydraulic flow to the open and close functions of choke actuator. For this instance, hydraulic fluid is supplied to the local choke accumulators, which are refilled by the hydraulic supply along an umbilical. The common choke actuator is a hydraulic stepping actuator which, depending on the style of actuator and choke being used, may take 100 to 200 steps to close. Each step involves the actuator receiving an electrical power pulse, followed by a pulse of hydraulic pressure, which moves the actuator, and then a release of the electrical power that releases the hydraulic pressure, which allows a spring to return the actuator to its initial position. In typical systems, roughly one second is required for the electrical power pulse to travel from the surface to the choke, and then for the pressure pulse to travel from the local choke accumulator to the actuator and roughly two seconds are required for the spring to return the actuator to its initial position. Thus, with a total of three to four seconds per step and a total of up to 200 steps required to fully actuate the choke, the time required to fully close or open the choke is considerable. The power requirements for this type of system are considerable, while the umbilical must have electrical conductors (one for open, one for close) for each choke.

U.S. Pat. No. 6,782,952 issued Aug. 31, 2004, discloses a hydraulic stepping valve actuator for moving the sliding sleeve of a downhole well valve. The system relies on a mechanical locking system to restrain the sleeve at each incremental position. As well, the system does not provide a fast close fail system, which is needed in a production well.

There remains a need in the art for systems and methods for increasing the responsiveness and speed of choke control systems, especially subsea systems.

SUMMARY OF THE INVENTION

Broadly stated, the invention provides a choke system with hydraulic controls for a hydraulic actuator. The invention includes a choke equipped with adjustable valve internals, and a hydraulically operated choke actuator operably connected through a stem to the adjustable valve internals such that incremental linear translating movement of the stem in response to incremental displacement of predetermined amounts of hydraulic fluid to or from the choke actuator adjusts the position of the adjustable valve internals. The choke actuator includes a biased piston sealed within a cylinder forming a first chamber and a second chamber on either side of the piston, with the piston being connected to the stem. The hydraulic control system of this invention eliminates excessive lines or solenoid valves and avoids the need for mechanical locking mechanisms. The hydraulic controls include:

- a hydraulic fluid supply system to supply pressurized fluid for reciprocation of the piston in the choke actuator;
- a first directional control valve connecting the hydraulic supply system to a first, biased, hydraulic slave cylinder which is in turn connected through hydraulic lines to each of the first and second chambers of the choke actuator, such that selective energization of the first directional control valve causes the first slave cylinder to deliver a discrete volume of hydraulic fluid to the first chamber of the choke actuator and a similar volume of hydraulic fluid to be removed from the second chamber of the choke actuator, causing the piston of the choke actuator to move incrementally in a direction against the bias of the choke actuator;
- a first, one way locking check valve in the hydraulic line connecting the first slave cylinder and the first chamber of the choke actuator to prevent reverse flow from the first chamber of the choke actuator, and thus locking the choke actuator against the bias between incremental movements;
- a first, one way fill check valve in the hydraulic line connecting the first slave cylinder and the second chamber of the choke actuator which allows hydraulic fluid being removed from the second chamber of the choke actuator to re-fill the first slave cylinder as the first directional control valve is de-energized;
- a second directional control valve connecting the hydraulic supply system to a second, biased hydraulic slave cylinder which is in turn connected through a hydraulic line to the first chamber of the choke actuator such that selective energization of the second directional control valve causes the second slave cylinder to remove a discrete volume of hydraulic fluid from the first chamber of the choke actuator, causing the piston of the choke actuator to move incrementally in the direction of the bias;
- a second, one way fill check valve in the hydraulic line connecting the second slave cylinder and the first chamber of the choke actuator which allows hydraulic fluid being removed from the lower chamber of the choke actuator to re-fill the second slave cylinder as the second directional control valve is de-energized;
- a one way check valve in a hydraulic line connecting the second slave cylinder and the hydraulic supply system to prevent supply pressure from entering the second slave cylinder during the re-filling action; and
- a control system operative to selectively energize and de-energize the first and second directional control valves.

Preferably, the choke system includes a fast close system. In one embodiment, the fast close system includes:

- a fast close hydraulic line interconnecting the first and second chambers of the choke actuator;
- a pilot operated check valve in the fast close hydraulic line; and
- a third directional control valve connected to the pilot operated check valve operative to open the pilot operated check valve in response to a fast close activation signal, whereby hydraulic fluid moves directly between the first and second chambers in order to allow the choke actuator to move in the direction of the bias.

In another embodiment, the fast close system includes:

- a fast close hydraulic line interconnecting the first and second chambers of the choke actuator; and
- a first, pilot operated check valve in a hydraulic line sensing pressure applied to the first slave cylinder and to provide pressure to a second pilot operated check valve which is located in the fast close hydraulic line, such that energization of both the first and second directional control valves opens the first pilot operated check valve and provides an opening pressure signal to the second pilot operated check valve, thus opening the fast close hydraulic line of the choke actuator in order to allow the choke actuator to move in the direction of the bias.

The slave cylinders and the choke actuator may be spring biased. Alternatively, the choke actuator may biased toward the closed position with a further hydraulic cylinder acting onto the choke actuator to function as a spring bias.

Definitions:

As used herein and in the claims, a reference to "a connection", "connected" or "connect(s)" is a reference to a hydraulic connection unless the context otherwise indicates.

As used herein and in the claims, the word "comprising" is used in its non-limiting sense to mean that items following the word in the sentence are included and that items not specifically mentioned are not excluded. The use of the indefinite article "a" in the claims before an element means that one of the elements is specified, but does not specifically exclude others of the elements being present, unless the context clearly requires that there be one and only one of the elements.

As used herein and in the claims, the terms "up" and "down"; "upper" and "lower"; "upwardly" and "downwardly"; "upstream" and "downstream"; "right" or "left" and other like terms indicating relative positions relative to a given point or element, are used to more clearly describe some embodiments of the invention as they appear in the figures. However, when applied to equipment and methods for use in wells, they may assume a different orientation, as will be evident to those skilled in the art.

In the description that follows, like parts are marked throughout the specification and drawings with the same reference numerals. The figures are not necessarily to scale. Certain features of the invention may be shown exaggerated in scale or in schematic form and some details of conventional elements may not be shown in the interest of clarity and conciseness. The present invention includes embodiments of different forms. Specific embodiments are shown in the drawings and described in detail herein with the understanding that the present disclosure is to be considered an exemplification of the principles of the invention, and is not intended to limit the invention to that illustrated and described herein. It is to be fully recognized that the different teachings of the embodiments discussed below may be employed separately or in any suitable combination to produce the desired results.

In particular, various embodiments of the present invention provide a number of different methods and apparatus for affecting control of a choke. The concepts of the invention are discussed in the context of a subsea choke but the use of the concepts of the present invention is not limited to subsea chokes specifically or choke assemblies generally. The concepts disclosed herein may find application in other choke assemblies, such as surface chokes, as well as other hydraulically actuated valves, both within oil field technology and other high pressure applications to which the current invention may be applied. Other embodiments of the choke system may include any subsea adjustable components, for example: chokes, downhole or below the mudline/tubing hangers, control valves, etc.

In the context of the following description, the term "choke" is used to refer to the family of valve devices incorporating a fixed or variable orifice having one or more adjustable valve internal parts (valve internals) that is used to control fluid flow rate or downstream system pressure. These devices may also be known as pressure control valves. Chokes are available for both fixed and adjustable modes of operation and can be used for production, drilling, or injection applications. Adjustable chokes enable the fluid flow and pressure parameters to be changed to suit process or production requirements. Types of chokes may include, but are not limited to, flow line chokes (whether stepping type, or infinitely variable type); subsea or surface separator/processing unit chokes (upstream or downstream) that enable smooth flow into or out from the subsea or surface separator/processing unit; subsea or surface chemical injection "metering" chokes, etc.

DETAILED DESCRIPTION OF THE INVENTION

Figure 1:
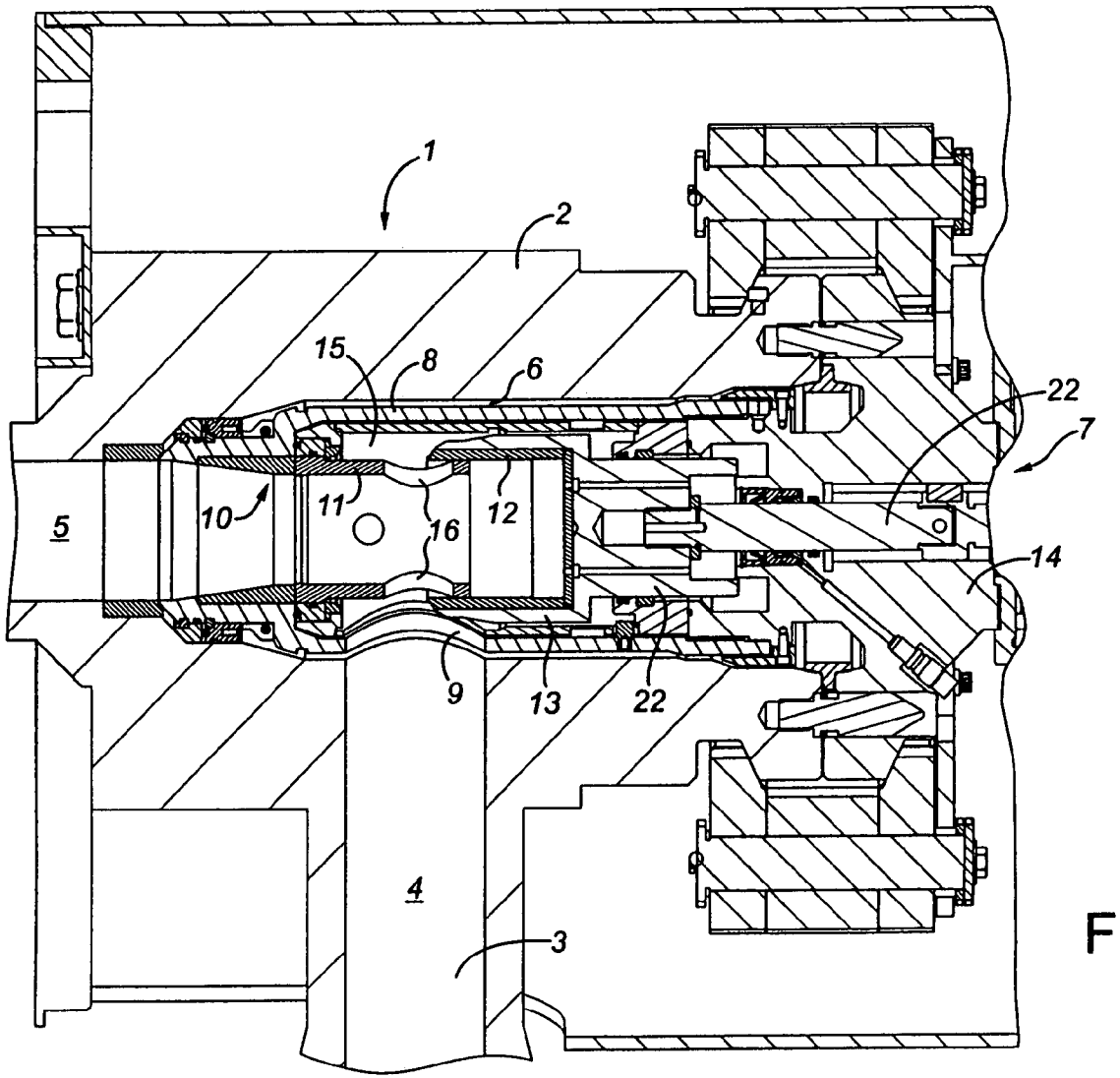
FIG. 1 is a cross-sectional side view of one embodiment of a subsea choke valve insert installed in a choke valve body.
Figure 2:
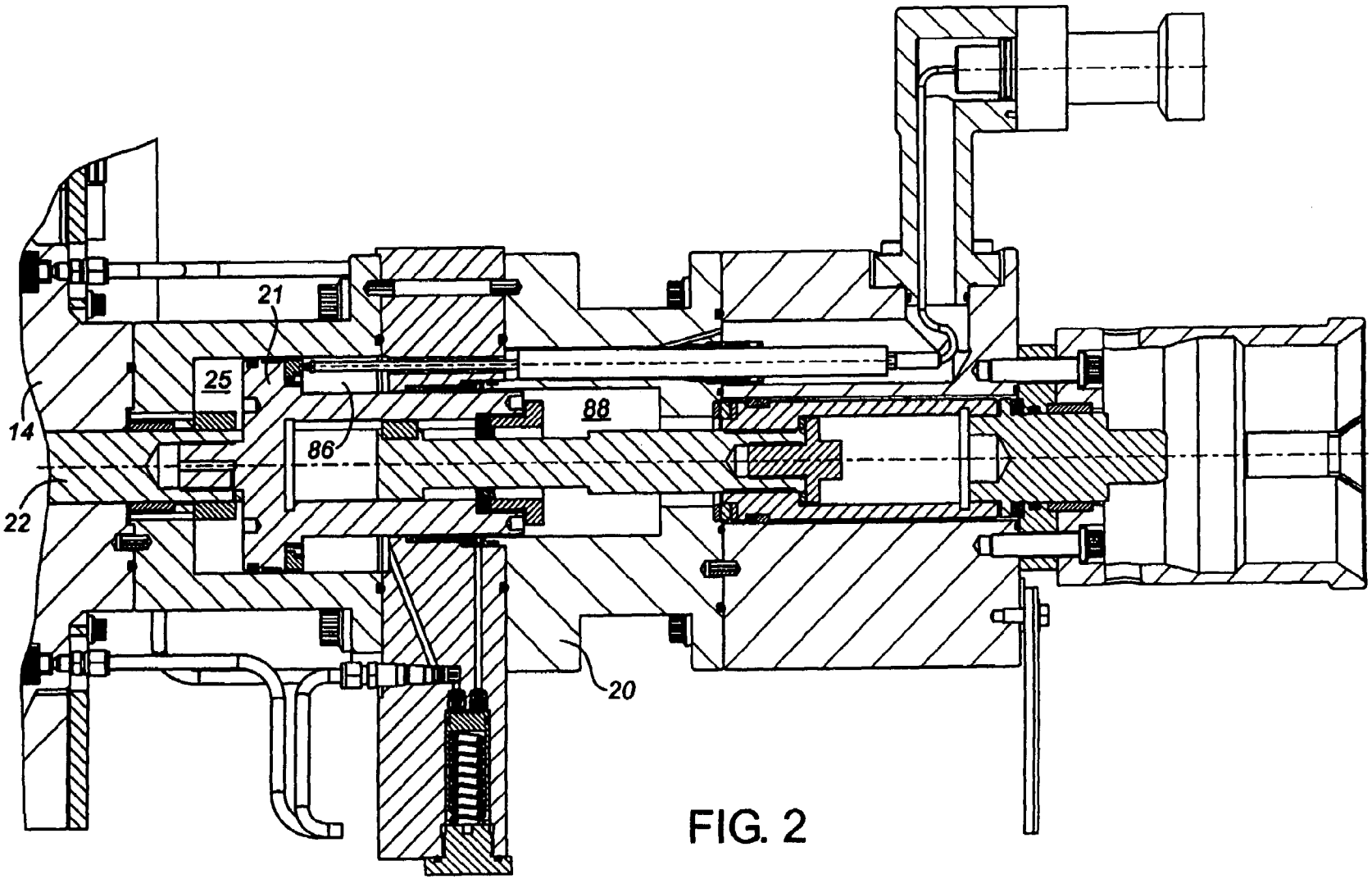
FIG. 2 is a cross-sectional side view of one embodiment of a choke actuator of this invention, shown acting on the choke stem of the choke of FIG. 1.

The hydraulics and controls for the choke system of the present invention are illustrated schematically in multiple embodiments in FIGS. 3–6. In FIG. 1, one embodiment of a typical subsea choke is illustrated, this being exemplary of the choke or other valve device having a choke stem 22 which can be controlled by the choke system of the present invention. In FIG. 2, an embodiment of the linear hydraulic actuator 20 of this invention, is shown operably connected to the choke stem 22 of the subsea choke of FIG. 1.

In FIG. 1, the subsea choke valve is shown generally at 1. It includes a choke body 2 forming a T-shaped bore 3 that provides an inlet 4 (body inlet), a bottom outlet 5 (body outlet) and a component chamber 6 (insert chamber). A removable insert assembly 7 is positioned in the component chamber 6, extending transversely of the inlet 4. The insert assembly 7 includes a tubular cartridge 8, forming a port 9, a flow trim 10 including a cage 11 and throttling sleeve 12, a collar assembly 13 and a bonnet 14. The bonnet 14 is disengagably clamped to the valve body 2. It closes the upper ends of the valve body 2 and the cartridge 8. The collar assembly 13 and choke stem 22 extends through the bonnet 14 into the cartridge bore 15 to bias the sleeve 12 along the cage 11 to throttle the restrictive flow ports 16.

Figure 5:
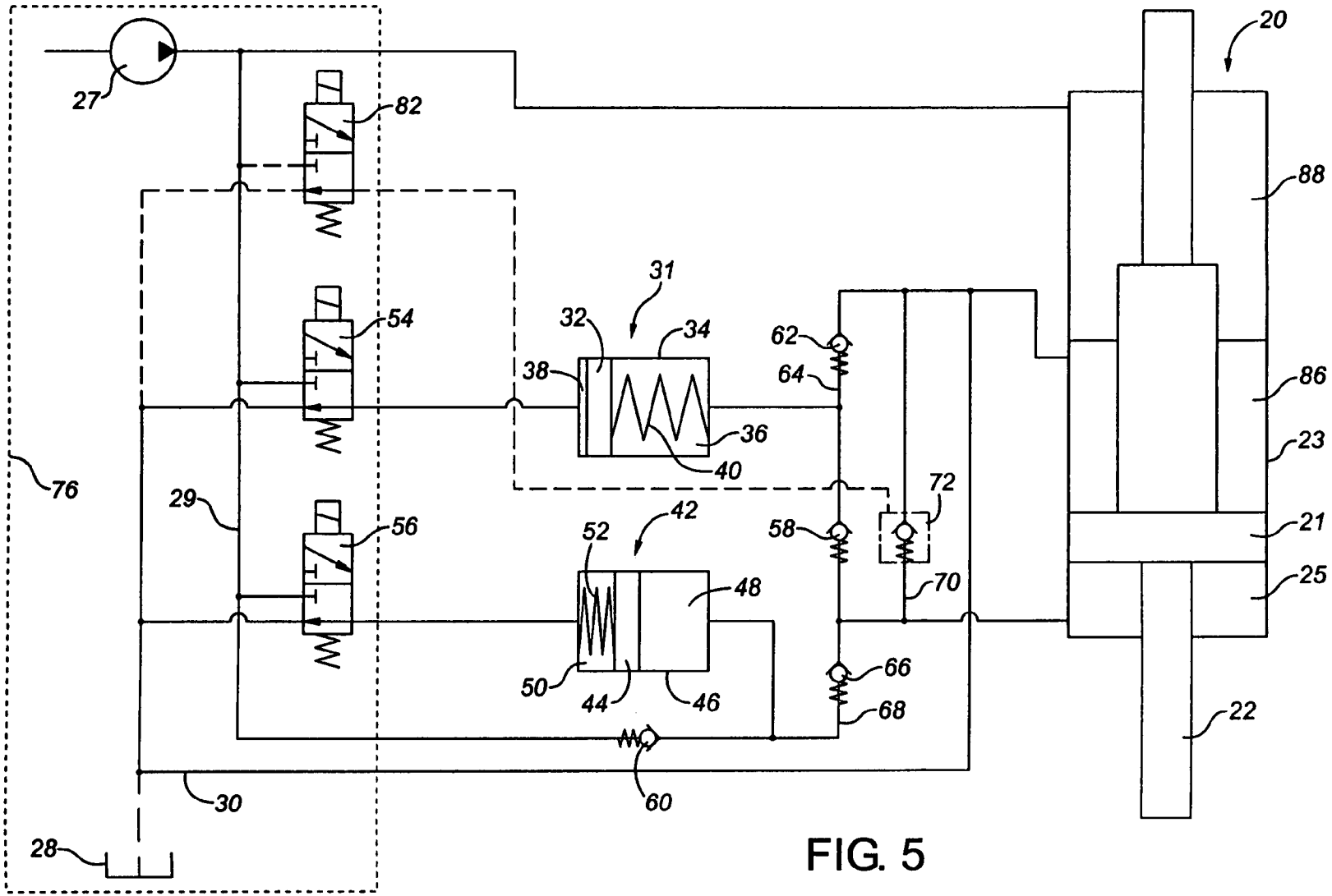
FIG. 5 is a schematic drawing of a third embodiment showing a double acting hydraulic fail close five line system with three solenoid valves.
Figure 6:
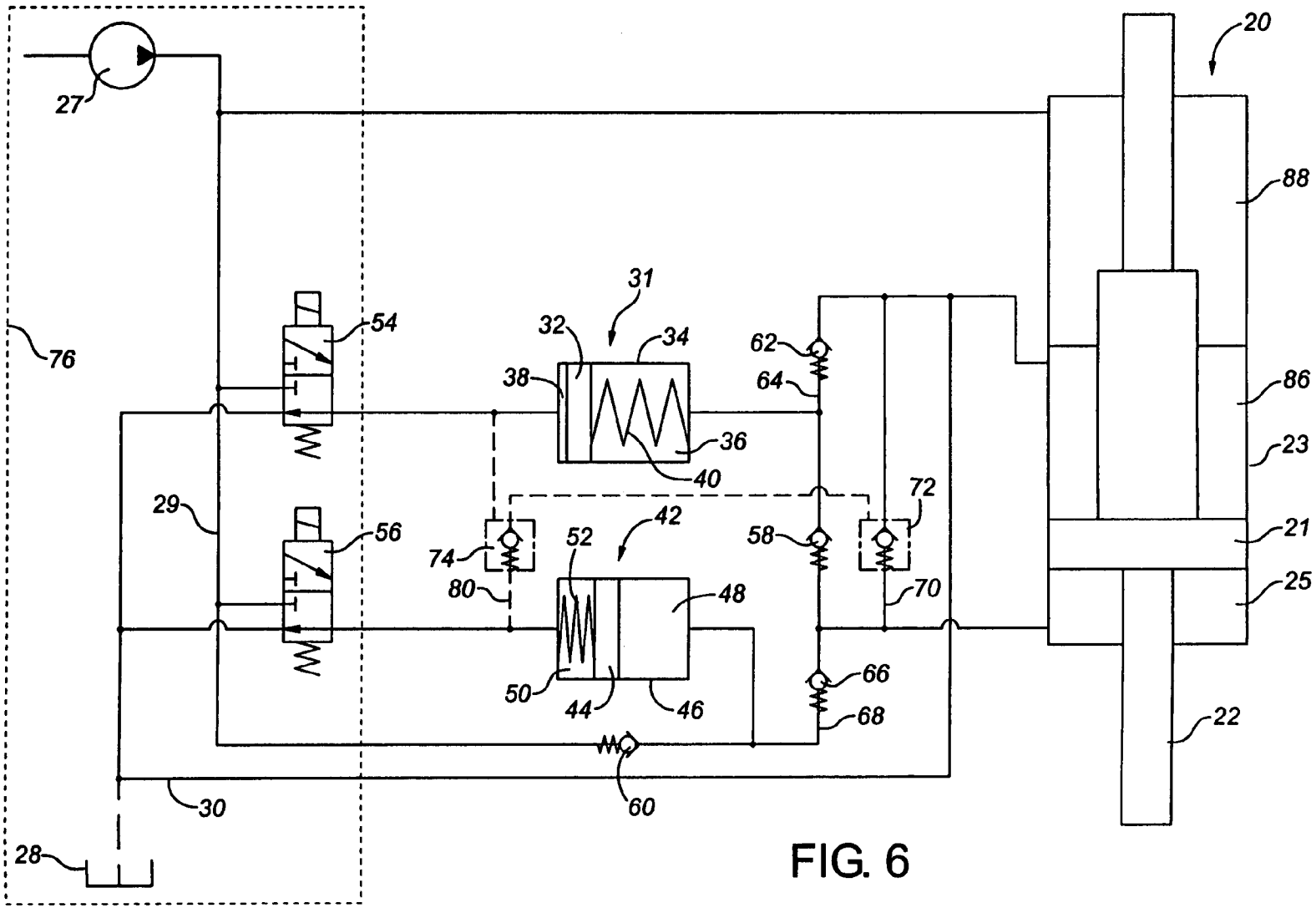
FIG. 6 is a schematic drawing of a fourth embodiment showing a double acting hydraulic fail close four line system with two solenoid valves.

In FIG. 2, the choke actuator 20 of this invention is as shown schematically in FIGS. 5 and 6, where a three chamber (25, 86 and 88) double acting actuator cylinder is used to bias the piston 21 of the actuator 20, in order to linearly translate the choke stem 22 of the choke in FIG. 1.

Figure 3:
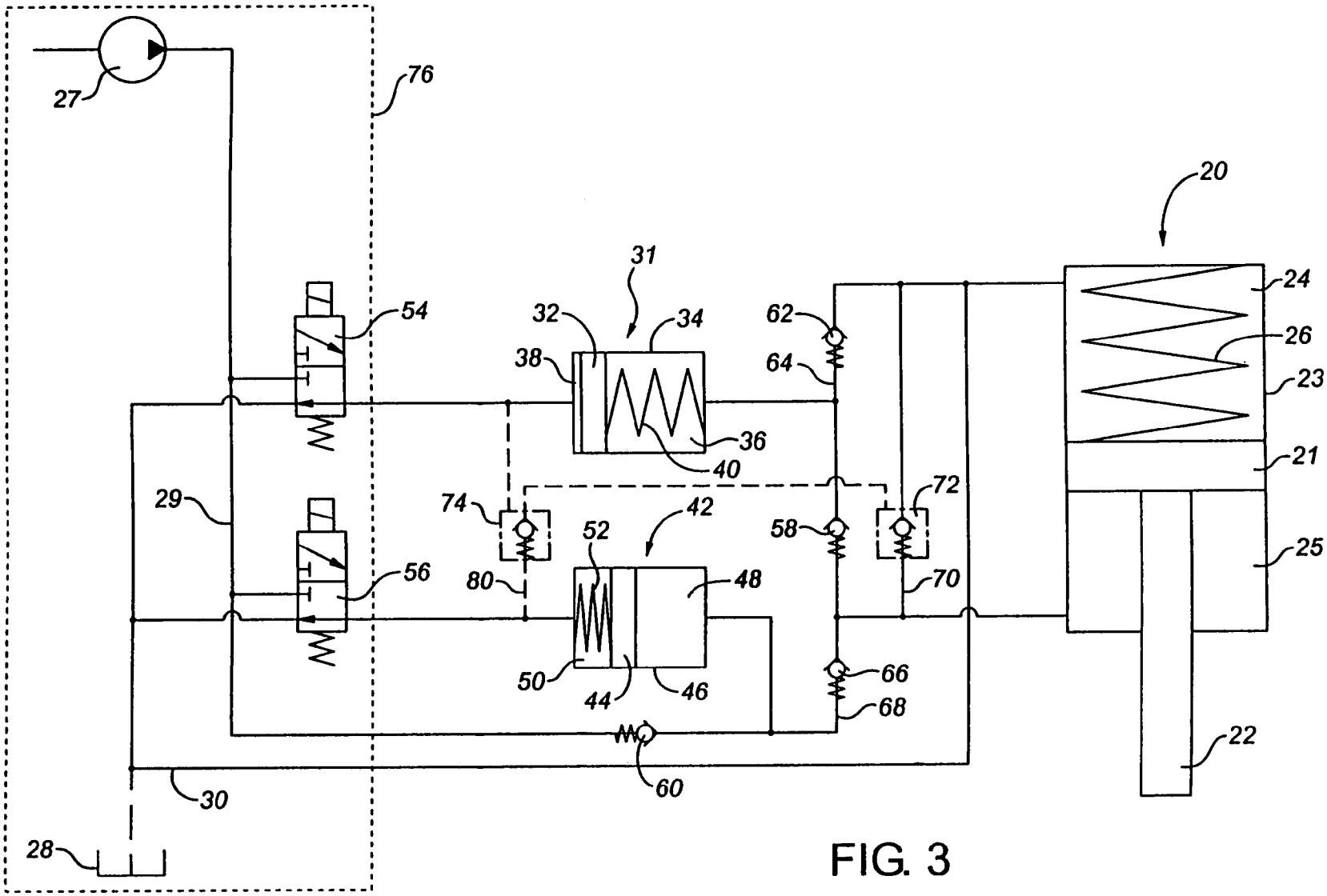
FIG. 3 is a schematic drawing of a first embodiment of the invention showing a single acting, spring fail close four line system with two solenoid valves.
Figure 4:
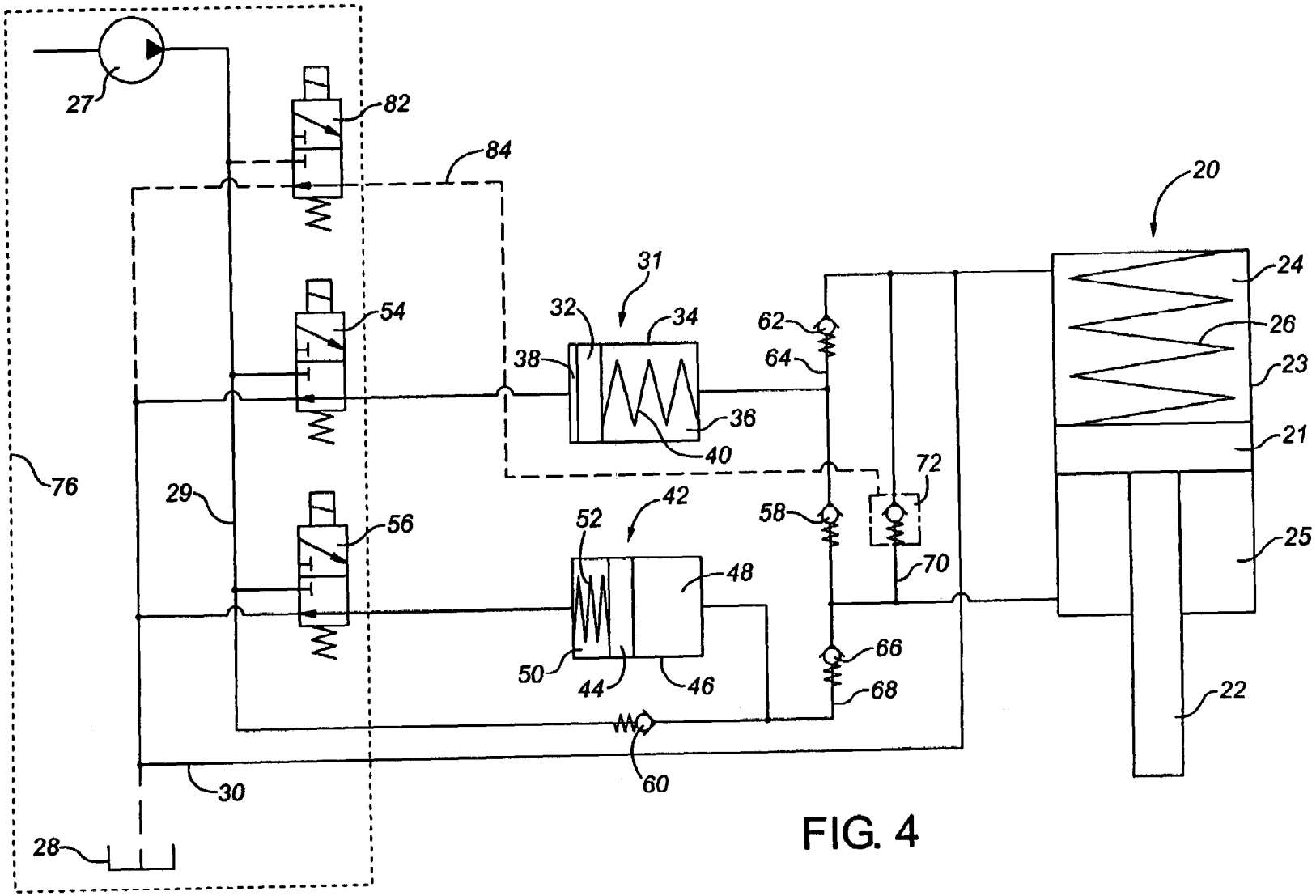
FIG. 4 is a schematic drawing of a second embodiment showing a single acting, spring fail close five line system with three solenoid valves.

The choke actuator 20 of this invention is preferably a hydraulic linear actuator, of the type commonly used in choke actuation to open, close or modulate the flow trim of a choke. Although not completely shown herein, it will be understood that, in the subsea environment, a subsea control module receives the open, close or fast close signals via one or more umbilical is from a surface control system via an electrical signal input. In FIGS. 3 and 4, the choke actuator 20 is shown to be a two chamber close biased spring-return hydraulic cylinder, however, an open biased spring-return hydraulic cylinder will also work. In FIGS. 5 and 6, the choke actuator 20 is shown to be a three chamber hydraulic cylinder (as in FIG. 2), with the pressurized hydraulic fluid supply providing the closing pressure on the choke actuator 20. Regardless of the type of choke actuator, it moves a piston 21 linearly in response to a discrete hydraulic fluid displacement from the chambers above and below the piston. The actuator 20 is biased to return to its initial position using a biasing spring or biasing hydraulic pressure. Each discrete hydraulic fluid displacement causes an incremental movement of the actuator, which causes linear adjustment of the flow trim in the choke to control the position of the flow trim and thereby modulate the flow rate through the choke.

The hydraulic circuit of this invention is shown in the Figures with four exemplary embodiments, each with its own advantages and disadvantages. Hydraulic circuit schematics of the four embodiments are depicted in the FIGS. 3–6. The preferred components vary slightly between figures, but in general for FIG. 3 include the following components, for which like parts are labeled with like numbers in the embodiments of FIGS. 4–6:

- hydraulic actuator cylinder 20, with piston 21 and stem 22 moving linearly in sealed relationship within the main cylinder 23, upper and lower chambers 24, 25 being formed on either side of the piston 21, and spring 26 biasing the piston 21 toward the closed position;
- pressurized hydraulic fluid supply 27 (with drain 28) for providing hydraulic fluid under pressure through a supply line circuit 29 to the lower chamber 25 of the actuator cylinder 20, and via a low pressure return line circuit 30 from the upper chamber 24 of the actuator cylinder 20;
- opening slave hydraulic cylinder 31 in the supply line circuit 29, connected to the lower chamber 25 of the actuator cylinder 20, and including sealed piston 32 dividing the cylinder 34 into right and left chambers 36, 38, spring 40 in the right, fluid-filled chamber 36 biasing the piston toward the left;
- closing slave cylinder 42 in the supply line circuit 29 removing fluid from the lower chamber 25 of the actuator cylinder 20, and including sealed piston 44 dividing the cylinder 46 into right and left chambers 48, 50, spring 52 in the left chamber 50 biasing the piston toward the right, and the right chamber 48 being fluid-filled;
- opening solenoid operated control valve 54 (or other directional control valve) in the supply line circuit 29 connected to the opening slave cylinder 31;
- closing solenoid operated control valve 56 (or other directional control valve) in the supply line circuit 29 connected to the closing slave cylinder 42;
- first one way locking check valve 58 between opening slave cylinder 31 and lower chamber 25 of actuator cylinder 20, preventing reverse flow to the opening slave cylinder 31 and thus serving to lock the actuator cylinder 20 between steps;

second one way check valve 60 between closing slave cylinder 42 and supply line 29, preventing supply pressure from entering the second slave cylinder 42 during its re-filling step;

first one way filling check valve 62 in opening slave refill line 64 connecting the right chamber of the opening slave cylinder to the return line circuit 30 from the upper chamber 24 of the actuator cylinder 20, allowing opening slave cylinder to be re-filled when solenoid 54 is de-energized;

second one way filling check valve 66 in closing slave re-fill line 68 connecting the right chamber 48 of the closing slave cylinder 42 to the lower chamber 25 of the actuator cylinder 20, allowing closing slave cylinder 42 to be re-filled when solenoid 56 is de-energized;

fast close hydraulic line 70 interconnecting the upper and lower chambers 24, 25 of the actuator cylinder 20, pilot operated check valve 72 located in the fast close hydraulic line, pilot operated check valve 74 connected to pilot valve 72 and to the solenoids 54, 56 such that simultaneous energization of solenoids 54 and 56 is sensed by pilot valve 74 to open pilot valve 72, thus allowing direct movement of hydraulic fluid from the upper chamber 24 to the lower chamber 25 for fast close of the actuator cylinder 20;

control module 76 for hydraulic supply 27, drain 28, and solenoid operated control valves 54 and 56, any of which can be located remotely or adjacent the other hydraulic components, but for convenience are shown as part of the control module 76 in the figures.

Overview of Function

The hydraulic circuits provide choke valve positioning that can be varied by the use of incremental steps. The incremental movement, or steps in either the opening or closing direction is accomplished through the use of one of the two hydraulic slave cylinders 31, 42 which can either add or subtract a fixed volume of hydraulic fluid from the actuator cylinder 20. A series of check valves provides direction for flow in the hydraulic lines, locking of the actuator cylinder 20, and re-filling of the slave cylinders 31, 42 during operation and eliminates excessive lines or solenoid valves from the system.

Each embodiment of FIGS. 3–6 is shown to include a method to provide "fast close" operation, that is, instead of running through a series of steps to close the valve, a single action is able to move the valve to a biased position from anywhere in the travel over a shorter period of time than through normal stepping operation.

Fluid power, solenoid valves, drain and control are typically external to the system on a control module, but have been included in the schematics for the purposes of explanation.

Operation

Each of the four embodiments is shown with similar mechanisms for the open and close steps. The fundamental difference between the four configurations lies in how to provide the closing force on the top of the actuator piston and how to accomplish the "fast close" function.

In each embodiment, to effect a single step in the open direction on the actuator cylinder 20 solenoid valve 54 is energized. This allows high pressure fluid from supply 27 to push the piston 32 in opening slave cylinder 31 through its travel thereby displacing all the fluid that was in the right chamber 36 of the opening slave cylinder 31 into the lower chamber 25 of the actuator cylinder 20. The added volume moves the piston 21 in the actuator cylinder 20 a proportionate distance. When the solenoid valve 54 is de-energized, the pressure in the opening slave cylinder 31 is released. The spring 40 in the opening slave cylinder 31 then returns the piston 32 to the original position while drawing fluid from the upper chamber 24 of the actuator cylinder 20 and thus resetting for the next open step.

When solenoid valve 56 is in the de-energized state high pressure fluid from the lower chamber 25 of the actuator cylinder 20 is able to overcome the spring force in the closing slave cylinder 42, as shown in FIG. 3. To effect a single step in the closed direction solenoid valve 56 is energized and the piston 44 in the closing slave cylinder 42 starts to move through its stroke. As the piston 44 moves the pressure across the piston 44 equalizes and the spring 52 continues to provide enough force to move the piston 44 through its entire travel. The fluid existing in the right chamber 48 of the closing slave cylinder 42 is ejected back into the supply line 29. When solenoid valve 56 is de-energized fluid is vented from the left chamber 50 of the closing slave cylinder 42 and the pressure in the lower chamber 25 of the actuator cylinder 20 resets the piston to the original position. The removal of the fluid from the lower chamber 25 of the actuator 20 results in the actuator piston 21 moving in the closed direction.

The invention will now be described with reference to each of the FIGS. 3–6. Operation of each of the four illustrated embodiments is set out below.

EMBODIMENT 1, FIG. 3

The closing force for the actuator 20 in this configuration is supplied by the spring 26 that acts on the top of the actuator piston 21. Fluid in the upper chamber 24 is used as a reservoir only for the opening slave cylinder 31. In order to activate the "fast close" mode in this configuration both solenoid valves 54 and 56 are energized. This allows reverse flow through the two pilot operated check valves 72, 74 to drain all fluid from the lower chamber 25 of the actuator cylinder 20, allowing the spring 26 to push the piston 21 and thus the choke valve to the full closed position.

FIG. 3 illustrates a hydraulic schematic that allows the communication between control module 76 and the actuator cylinder 20. The control module 76 functions as a fluid power distribution device located subsea that, through the use of solenoid operated control valves 54, 56, directs the fluid pressure as intended. All references to the solenoid operated control valves 54, 56 refers to operation of the control module 76 as these are contained within this system.

The configuration provides a means to produce incremental movement of the actuator cylinder 20 through selective energization of solenoid 54 or 56 (and thus slave cylinders 31 or 42). The extent of the increment movement of the actuator 20 can be controlled through sizing of the swept volume of the slave cylinders 31, 42. Thus, depending on the number of incremental movements desired in order to fully open or fully close the actuator 10, the ratio of the volume of the slave cylinder to the actuator can be adjusted (ex. 1:20 to open/close in 20 increments). The configuration is such that operation of the solenoid valves 54, 56 will result in an incremental movement of the actuator cylinder 20 in either the open or close direction respectively. Through energization of both solenoids 54 and 56 simultaneously, the spring bias actuator 20 closes rapidly (referred to as fast close option). Below, the operation of this embodiment is described in greater detail in three parts—open movement, close movement, and fast close.

Open Movement

Solenoid 54 is energized allowing pressurized fluid from the hydraulic supply 27 to move into the left chamber 38 of the slave cylinder 31. This pressurized fluid acts onto the slave cylinder piston 32 and against the internally biased spring 40. The opening slave cylinder 31 consists of a housing cylinder 34 to contain the fluid pressure, similar to a closed end cylinder. Within the cylinder 34, the piston 32 moves linearly with an adequate sealing membrane (not shown) preventing movement of fluid across the piston 32. The piston 32 is spring biased in the open position (toward the left chamber 38) through the compression spring 40 situated in the right chamber 36. Fluid entering the cylinder 34 forces the spring bias piston 32 within the slave cylinder 31 to stroke through its travel expelling the fluid from the right chamber 36. This controlled volume of fluid is pushed through one way check valve 58 and into the lower chamber 25 of the actuator cylinder 20 resulting in a controlled discrete movement of the actuator piston 21. The purpose of check valve 58 is to allow communication between the opening slave cylinder 31 and the actuator 20, while preventing reverse fluid movement from the actuator 20 to slave cylinder 31 when solenoid 54 is de-energized. This ensures that the actuator 20 remains locked in position without the use of a mechanical locking device, as shown in the prior art. An example of a suitable check valve for this purpose is a Bucher Hydraulics model RKVG-06-Z4, however many other known commercial models will perform the function, as will be readily evident to those skilled in the art. When solenoid 54 is de-energized the opening slave cylinder piston 32 returns to its neutral position through the spring bias. As the cylinder piston 32 moves to the neutral position fluid is drawn into the right chamber 36 of the cylinder 31 through re-fill one way check valve 62. Check valve 62 is in communication with the fluid on the upper chamber 24 of the actuator 20 and the return line 30 to the drain 28. The filling process of the right chamber 36 of the opening slave cylinder 31 prepares the system for the next incremental step.

Closed Movement

Solenoid 56 is energized allowing pressurized fluid from the hydraulic supply 27 to move into the left chamber 50 of the closing slave cylinder 42. The closing slave cylinder 42 consists of a housing cylinder 46 to contain the fluid pressure, similar to a closed end cylinder. Within the cylinder 46 exists the piston 44 with an adequate sealing membrane (not shown) to prevent movement of fluid across the piston 44. The piston 44 is spring biased in the extended position through a compression spring 52 situated between the left chamber 50 between the piston 44 and the cylinder end. Pressurized fluid entering the closing slave cylinder 42 from solenoid valve 56 equalizes the pressure load on the closing slave cylinder piston 44. The spring bias feature within closing slave cylinder 42 forces the piston 44 to stroke through its travel expelling the fluid from the right chamber 48 of the cylinder 46 through one way check valve 60 into the supply line circuit 29. One way check valve 66 prevents movement of the fluid into the actuator 20 while orientation of check valve 60 allows fluid to move into the supply line circuit 29. When solenoid 56 is de-energized communication between the left chamber 50 of the closing slave cylinder 42 and the low pressure return pressure line 30 is restored. The cylinder piston 44 is retracted against spring bias due to the higher pressure in the lower chamber 25 of the actuator 20. This movement of the closing slave cylinder 42 absorbs fluid from the lower chamber 25 of the actuator 20 equal to the swept volume of the closing slave cylinder piston 44. The spring bias on the actuator 20 compensates for this fluid loss by moving the piston 21 in the actuator 20 downwardly proportionally. This results in incremental distinct movement of the actuator 20. When the closing slave cylinder piston 44 fully retracts, the system is set for the next operation.

Fast Close Function

The incorporation of a fast close system can be integrated in the open/close circuits described above. A pilot operated check valve 74 is provided in a line 80 connecting supply line circuit 29 at a point between the solenoids 54, 56 and the slave cylinders 31, 42. Pilot valve 74 is connected to the pilot valve 72 which in turn is located in the fast close line 70 between the upper and lower chambers 24, 25 of the actuator 20. In this way pressure sensed at pilot valve 74 when both solenoids 54, 56 are energized is communicated to the pressure sensing port of the pilot operated check valve 72, which opens direct communication in fast close line 70 between the upper and lower chambers 24, 25 of the actuator 20. The spring bias of the actuator 20 causes a fast close without consumption of additional fluid. An example of a suitable device for the pilot operated check valves would be Bucher Hydraulics model ERVH-1, however many commercial models will perform the function, as well known to those skilled in the art.

EMBODIMENT 2, FIG. 4

This embodiment adds a third solenoid operated control valve 82 (or other directional control valve) for directly activating the "fast close" feature with a single pilot operated check valve 72 in the fast close line 70, thereby eliminating pilot valve 74 from FIG. 3. The open and close stepping functions are otherwise the same as described for FIG. 3, with the upper chamber 24 of the actuator cylinder 20 being used only as a supply storage for the opening slave cylinder 31. When solenoid valve 82 is energized, pressurized fluid is allowed to travel through fast close control line 84 to release the pilot check valve 72. All references to the solenoid operated control valves in the following text will refer to operation of the control module 76 as these are contained within this apparatus.

Open Movement

Solenoid 54 is energized allowing pressurized fluid from the hydraulic supply 27 to move into the left chamber 38 of the opening slave cylinder 31. This pressurized fluid acts onto the slave cylinder piston 32 and against the internally biased spring 40. Fluid entering the left chamber 38 forces the spring bias piston 32 within the slave cylinder 31 to stroke through its travel expelling the fluid from the right chamber 36 of the cylinder 34. This controlled volume of fluid is pushed through check valve 58 and into the lower chamber 25 of the valve actuator 20 resulting in a controlled discrete movement of the actuator piston 21. As for FIG. 3, check valve 58 allows communication between the slave cylinder 31 and the valve actuator 20, however prevents fluid movement from the actuator 20 to the slave cylinder 31 when solenoid 54 is de-energized. This ensures that the valve actuator 20 remains locked in position. When solenoid 54 is de-energized the slave cylinder piston 32 returns to its neutral position through the spring bias. As the cylinder piston 32 moves to the neutral position fluid is drawn into the right chamber 36 of the cylinder 34 through check valve 62. Check valve 62 is in communication with the fluid on the upper chamber 24 of valve actuator 20 and the return line 30 to the drain 28. The filling process of the right chamber 36 of the slave cylinder 31 prepares the system for the next incremental step.

Closed Movement

Solenoid 56 is energized allowing pressurized fluid from the fluid supply 27 to move into the left chamber 50 of the closing slave cylinder 42. The piston 44 is spring bias in the extended position through the compression spring 52 situated between the left chamber 50. Pressurized fluid entering the slave cylinder 42 from solenoid valve 56 equalizes the pressure load on the slave cylinder piston 44. The spring bias feature within the slave cylinder 42 forces the piston 44 to stroke through its travel expelling the fluid from the right chamber 48 through check valve 60 into the supply line circuit 29. Check valve 66 prevents movement of the fluid into the valve actuator 20 while orientation of check valve 60 allows fluid to move into the supply line circuit 29. When solenoid 56 is de-energized communication between the left chamber 50 of the slave cylinder 42 and the low pressure return pressure line 30 is restored. The cylinder piston 44 is retracted against spring bias due to the higher pressure in the lower chamber 25 of the valve actuator 20. This movement of the slave cylinder 42 absorbs fluid from the lower chamber 25 of the actuator 20 equal to the swept volume of the slave cylinder piston 44. The spring bias on valve actuator 20 compensates for this fluid loss by moving the piston 21 in the valve actuator 20 down proportionally. This results in incremental distinct movement of the valve actuator 20. When the slave cylinder piston 44 fully retracts, the system is set for the next operation.

Fast Close Function

The incorporation of a fast close system can be integrated within the circuit by using the third solenoid operated control valve 82 from the control module 76. The circuit involves connecting this control valve 82 to the pilot operated check valve 72 positioned to enable communication of the upper and lower chambers 24, 25 of the valve actuator 20 through fast close line 70. As pressure is applied to the pilot operated check valve 72 the connection of the fast close line 70 equalizes the pressure across the piston 21 in the valve actuator 20. The spring bias of the valve actuator 20 closes the actuator 20 without consumption of additional fluid.

EMBODIMENT 3, FIG. 5

This embodiment varies considerably from the previous two embodiments in that it uses a dual acting hydraulic cylinder as the actuator 20, which in effect divides the upper chamber 24 of the previous embodiment into two chambers, a middle chamber 86 and an uppermost chamber 88. The uppermost chamber 88 is under supply pressure during all operational periods thus biasing the piston 21 in the closed direction. The open and closed stepping functions are otherwise similar to those of FIGS. 3 and 4.

The "fast close" mechanism for in this schematic is similar to that used in FIG. 4. When solenoid valve 82 is energized the pilot operated check valve 72 allows reverse flow and dumps all the pressure in the lower chamber 25 of the actuator cylinder 20 to middle chamber 86 which is at vent pressure. Uppermost chamber 88 is still pressurized to supply pressure and as such the actuator piston 21 moves to the full closed position.

This embodiment of the invention thus replaces the spring used to bias the actuator in FIGS. 3 and 4 with a two chamber fluid cylinder connected directly to the fluid supply source 27.

Open Movement

Operation of open solenoid valve 54 results in pressurized fluid moving into the opening slave cylinder 31. Fluid entering the cylinder 34 forces the spring bias piston 32 within the slave cylinder 31 to stroke through its travel expelling the fluid from the right chamber portion 36 of the cylinder 34. This controlled volume of fluid is pushed through check valve 58 and into the lower chamber 25 of the actuator 20 resulting in a controlled discrete movement of the actuator 20. The effective piston area acted upon by the pressure in lower chamber 25 overcomes the small effective area in uppermost chamber 88 moving the actuator 20 the relative distance of the swept volume of the piston 32 in opening slave cylinder 31.

Closed Movement

Solenoid 56 is energized allowing pressurized fluid from the hydraulic supply 27 to move into the left chamber 50 of the closing slave cylinder 42. Pressurized fluid entering the closing slave cylinder 42 from solenoid valve 56 equalizes the pressure load on the slave cylinder piston 44. The spring bias feature within closing slave cylinder 42 forces the piston 44 to stroke through its travel expelling the fluid from the right chamber 48 of the cylinder 46 through check valve 60 into the supply line 29. Check valve 66 prevents movement of the fluid into the actuator 20 while orientation of check valve 60 allows fluid to move into the supply line circuit 29. When solenoid 56 is de-energized communication between the left chamber 50 of the closing slave cylinder 42 and the low pressure return pressure line 30 is restored. The cylinder piston 44 is retracted against spring bias due to the higher pressure in the lower chamber 25 of the actuator 20. This movement of the slave cylinder 42 absorbs fluid from the lower chamber 25 of the actuator 20 equal to the swept volume of the closing slave cylinder piston 44. The supply pressure acting upon the uppermost chamber 88 compensates for this fluid loss by moving the piston 21 in the actuator 20 downwardly proportionally. This results in incremental distinct movement of the actuator 20. When the closing slave cylinder piston 44 fully retracts, the system is set for the next operation.

Fast Close Function

The incorporation of a fast close system is included within the circuit by using the third solenoid operated control valve 82 from the control module 76. By connecting this solenoid control valve 82 to the pilot operated check valve 72, communication in the fast close line 70 connecting middle and lower chambers 86, 25 is opened, equalizing the pressure in these chambers 86, 25 with the pressure in the return line 30. The supply pressure acting on uppermost chamber 88 forces the actuator 20 to close.

EMBODIMENT 4, FIG. 6

This configuration combines the use of two solenoid valves 54, 56 as shown in FIG. 3 and the three chamber double acting actuator cylinder 20 of FIG. 5 to obtain a further system. The "fast close" mechanism is identical to the system of FIG. 3, except that supply pressure that is continuously applied to uppermost chamber 88 provides the closing force instead of a spring.

Open Movement

Operation of open solenoid valve 54 results in pressurized fluid moving into the opening slave cylinder 31. Fluid entering the cylinder 34 forces the spring bias piston 32 within the slave cylinder 31 to stroke through its travel expelling the fluid from the right chamber 36. This controlled volume of fluid is pushed through check valve 58 and into the lower chamber 25 of the valve actuator 20 resulting in a controlled discrete movement of the actuator 20. The effective piston area acted upon by the pressure in lower chamber 25 overcomes the small effective area in the uppermost chamber 88 moving the valve actuator 20 the relative distance of the swept volume of the piston 32 in opening slave cylinder 31. Check valve 58 allows communication between the slave cylinder 31 and the valve actuator 20, however prevents fluid movement from the actuator 20 to the slave cylinder 31 when solenoid 54 is de-energized. This ensures the actuator 20 remains locked in position without the use of a mechanical locking device, as mentioned above.

Closed Movement

Solenoid 56 is energized allowing pressurized fluid from the hydraulic supply 27 to move into the left chamber 50 of the closing slave cylinder 42. Pressurized fluid entering the slave cylinder 42 from solenoid valve 56 equalizes the pressure load on the slave cylinder piston 44. The spring bias feature within slave cylinder 42 forces the piston 44 to stroke through its travel expelling the fluid from the right chamber 48 through check valve 60 into the supply line circuit 29. Check valve 66 prevents movement of the fluid into the valve actuator 20 while orientation of check valve 60 allows fluid to move into the supply line circuit 29. When solenoid 56 is de-energized, communication between the left chamber 50 of the slave cylinder 42 and the low pressure return pressure line 30 is restored. The cylinder piston 44 is retracted against the spring bias due to the higher pressure in the lower chamber 25 of the actuator 20. This movement of the slave cylinder piston 44 absorbs fluid from the lower chamber 25 of the actuator 20 equal to the swept volume of the slave cylinder piston 44. The supply pressure 27 acting upon the uppermost chamber 88 of the actuator 20 compensates for this fluid loss by moving the piston 21 in the actuator 20 down proportionally. This results in incremental distinct movement of the actuator 20. When the closing slave cylinder piston 44 fully retracts, the system is set for the next operation.

Fast Close Function

The incorporation of a fast close system can be integrated in the open/close circuits described above. A pilot operated check valve 74 is provided in a line 80 connecting supply line circuit 29 at a point between the solenoids 54, 56 and the slave cylinders 31, 42. Pilot valve 74 is connected to the pilot valve 72 which in turn is located in the fast close line 70 between the middle chamber 86 and the lower chambers 25 of the actuator 20. In this way pressure sensed at pilot valve 74 when both solenoids 54, 56 are energized is communicated to the pressure sensing port of the pilot operated check valve 72. The pressure opens pilot valve 72 and allows communication of the fluid from the lower chambers 25 and the middle chamber 86 of the actuator 20 through connection of the fast close line 70 with the low pressure return line circuit 30. The pressure supply 27 connected directly to the uppermost chamber 88 closes the actuator 20.

Variations/Extensions

The invention extends to variations of these systems which will be evident to those skilled in the art, including without limitation.

A manual override extension, whether it be rotary or hydraulic, may be provided.

The piston in the actuator may have unequal areas on each side.

The springs that may or may not be used in this application are not limited to the coil type shown as other types of springs may be used.

Fewer or additional check valves may be used, and the number of connections needed may be reduced or increased from that shown.

While the system has particular application for subsea choke valves, it has broad application, including, without limitation surface choke valves.

All publications mentioned in this specification are indicative of the level of skill in the art of this invention. All publications are herein incorporated by reference to the same extent as if each publication was specifically and individually indicated to be incorporated by reference.

The terms and expressions in this specification are, unless otherwise specifically defined herein, used as terms of description and not of limitation. There is no intention, in using such terms and expressions, of excluding equivalents of the features illustrated and described, it being recognized that the scope of the invention is defined and limited only by the claims which follow.

What is claimed is:

1. A choke system with hydraulic controls for a hydraulic actuator, comprising:

a choke equipped with adjustable valve internals;

a hydraulically operated choke actuator operably connected through a stem to the adjustable valve internals such that incremental linear translating movement of the stem in response to incremental displacement of predetermined amounts of hydraulic fluid to or from the choke actuator adjusts the position of the adjustable valve internals, said choke actuator comprising a biased piston sealed within a cylinder forming a first chamber and a second chamber on either side of the piston, said piston being connected to the stem;

a hydraulic fluid supply system to supply pressurized fluid for reciprocation of the piston in the choke actuator;

a first directional control valve connecting the hydraulic supply system to a first, biased, hydraulic slave cylinder which is in turn connected through hydraulic lines to each of the first and second chambers of the choke actuator, such that selective energization of the first directional control valve causes the first slave cylinder to deliver a discrete volume of hydraulic fluid to the first chamber of the choke actuator and a similar volume of hydraulic fluid to be removed from the second chamber of the choke actuator, causing the piston of the choke actuator to move incrementally in a direction against the bias of the choke actuator;

a first, one way locking check valve in the hydraulic line connecting the first slave cylinder and the first chamber of the choke actuator to prevent reverse flow from the first chamber of the choke actuator, and thus locking the choke actuator against the bias between incremental movements;

a first, one way fill check valve in the hydraulic line connecting the first slave cylinder and the second chamber of the choke actuator which allows hydraulic fluid being removed from the second chamber of the choke actuator to re-fill the first slave cylinder as the first directional control valve is de-energized;

a second directional control valve connecting the hydraulic supply system to a second, biased hydraulic slave cylinder which is in turn connected through a hydraulic line to the first chamber of the choke actuator such that selective energization of the second directional control valve causes the second slave cylinder to remove a discrete volume of hydraulic fluid from the first chamber of the choke actuator, causing the piston of the choke actuator to move incrementally in the direction of the bias;

a second, one way fill check valve in the hydraulic line connecting the second slave cylinder and the first chamber of the choke actuator which allows hydraulic fluid being removed from the lower chamber of the choke actuator to re-fill the second slave cylinder as the second directional control valve is de-energized;

a one way check valve in a hydraulic line connecting the second slave cylinder and the hydraulic supply system to prevent supply pressure from entering the second slave cylinder during the re-filling action; and a control system operative to selectively energize and de-energize the first and second directional control valves.

2. The choke system of claim 1, wherein the first and second slave cylinders are spring biased hydraulic cylinders.

3. The choke system of claim 1, wherein the choke actuator is spring biased.

4. The choke valve of claim 1, wherein the choke actuator is spring biased toward the closed position, with the spring being located in the second chamber.

5. The choke valve of claim 1, wherein the choke actuator is biased toward the closed position with a further hydraulic cylinder acting onto the choke actuator to function as a spring bias.

6. The choke system of claim 1, which further comprises a fast close system, comprising:

a fast close hydraulic line interconnecting the first and second chambers of the choke actuator;

a pilot operated check valve in the fast close hydraulic line; and a third directional control valve connected to the pilot operated check valve operative to open the pilot operated check valve in response to a fast close activation signal, whereby hydraulic fluid moves directly between the first and second chambers in order to allow the choke actuator to move in the direction of the bias.

7. The choke system of claim 6, wherein the first and second slave cylinders are spring biased hydraulic cylinders.

8. The choke system of claim 6, wherein the choke actuator is spring biased.

9. The choke valve of claim 6, wherein the choke actuator is spring biased toward the closed position, with the spring being located in the second chamber.

10. The choke valve of claim 6, wherein the choke actuator is biased toward the closed position with a further hydraulic cylinder acting onto the choke actuator to function as a spring bias.

11. The choke system of claim 1, which further comprises:

a fast close hydraulic line interconnecting the first and second chambers of the choke actuator; and a first, pilot operated check valve in a hydraulic line sensing pressure applied to the first slave cylinder and to provide pressure to a second pilot operated check valve which is located in the fast close hydraulic line, such that energization of both the first and second directional control valves opens the first pilot operated check valve and provides an opening pressure signal to the second pilot operated check valve, thus opening the fast close hydraulic line of the choke actuator in order to allow the choke actuator to move in the direction of the bias.

12. The choke system of claim 11, wherein the first and second slave cylinders are spring biased hydraulic cylinders.

13. The choke system of claim 11, wherein the choke actuator is spring biased.

14. The choke valve of claim 11, wherein the choke actuator is spring biased toward the closed position, with the spring being located in the second chamber.

15. The choke valve of any of claim 11, wherein the choke actuator is biased toward the closed position with a further hydraulic cylinder acting onto the choke actuator to function as a spring bias.

16. The choke system of claim 1, in which the choke is a subsea choke, comprising:

a) a valve body forming a bore extending therethrough which provides a body inlet, a body outlet and an insert chamber therebetween;

b) a removable insert assembly positioned in the insert chamber and comprising:

i. a tubular cartridge having a side wall forming an internal bore and having a port communicating with the body inlet, whereby high pressure fluid enters through the body inlet, ii. a bonnet connected with and closing the upper ends of the cartridge and the body, the bonnet being disengagably connected with the body, and iii. a pressure reducing flow trim positioned in the cartridge bore, the flow trim having a restrictive opening whereby fluid from the body inlet may enter the flow trim at reduced pressure and pass through the body outlet; and iv. a stem extending through the bonnet, for biasing the flow trim so as to throttle flow; therethrough; and wherein the choke actuator is operably connected to the stem so as to adjust the position of the flow trim in response to hydraulic signals.

17. The choke system of claim 16, wherein:

in (a), the bore is T-shaped to provide a horizontal side inlet, a vertical bottom outlet and a vertical insert chamber;

in (b) iii, the pressure reducing flow trim comprises a tubular cage, aligned with the body outlet, and a throttling sleeve slidable over the cage, the cage having a side wall forming an internal bore and restrictive flow parts aligned with the cartridge side port and the inlet, whereby fluid from the body inlet may enter the cage bore at reduced pressure and pass through the bottom outlet, and the stem extends through the bonnet, for biasing the throttling sleeve over the cage ports.

* * * * *